US010182642B2

(12) United States Patent
Khormaei

(10) Patent No.: US 10,182,642 B2
(45) Date of Patent: Jan. 22, 2019

(54) DEEP PORE CLEANSING DEVICE CONFIGURED TO DELIVER A CYCLICAL MECHANICAL STRAIN AND MIST TO SKIN

(71) Applicant: L'OREAL, Paris (FR)

(72) Inventor: Iranpour Khormaei, Vancouver, WA (US)

(73) Assignee: L'OREAL, Paris (FR)

( * ) Notice: Subject to any disclaimer, the term of this patent is extended or adjusted under 35 U.S.C. 154(b) by 438 days.

(21) Appl. No.: 14/711,534

(22) Filed: May 13, 2015

(65) Prior Publication Data

US 2016/0331106 A1 Nov. 17, 2016

(51) Int. Cl.

| | |
|---|---|
| ***A46B 11/00*** | (2006.01) |
| ***A46B 7/08*** | (2006.01) |
| ***A61H 7/00*** | (2006.01) |
| ***A46B 11/08*** | (2006.01) |
| ***A46B 13/02*** | (2006.01) |
| ***A47K 7/04*** | (2006.01) |
| *A61H 33/12* | (2006.01) |

(Continued)

(52) U.S. Cl.

CPC ..... *A46B 7/08* (2013.01); *A46B 11/0017* (2013.01); *A46B 11/08* (2013.01); *A46B 13/02* (2013.01); *A47K 7/043* (2013.01); *A46B 2200/1006* (2013.01); *A61H 7/005* (2013.01); *A61H 33/12* (2013.01); *A61H 2033/0029* (2013.01); *A61H 2033/061* (2013.01); *A61H 2201/0153* (2013.01); *A61H 2201/0207* (2013.01); *A61H 2201/0228* (2013.01); *A61H 2201/105* (2013.01); *A61H 2201/1207* (2013.01); *A61H 2201/1671* (2013.01); *A61H 2201/1695* (2013.01); *A61H 2201/5038* (2013.01)

(58) Field of Classification Search

CPC ..... A61H 33/12; A61H 2033/0029; A61H 2201/0228; A61H 2201/0207; A46B 11/001; A46B 11/0017; A46B 11/0062; A46B 11/0065; A46B 11/08; A46B 7/08; A46B 13/02; A46B 2200/1006; A47K 7/043

See application file for complete search history.

(56) References Cited

U.S. PATENT DOCUMENTS 3,158,891 A * 12/1964 Long ..... A46B 11/08 239/136

6,090,085 A 7/2000 Mehl, Sr. et al.

(Continued)

FOREIGN PATENT DOCUMENTS

| | | |
|---|---|---|
| CN | 102380146 A | 3/2012 |
| EP | 1 991 195 B1 | 11/2008 |
| KR | 10-1336371 B1 | 12/2013 |

OTHER PUBLICATIONS

Search Report and Written Opinion dated Jun. 24, 2016, in International Application No. PCT/US2016/021978.

*Primary Examiner* — Timothy Stanis

(74) *Attorney, Agent, or Firm* — Oblon, McClelland, Maier & Neustadt, L.L.P.

(57) ABSTRACT

A portable skin cleaning apparatus that includes a cleanser assembly and a mist dispenser assembly. The cleanser assembly is configured to apply a cyclical mechanical force to a skin surface area of a user with a cleaning object. The mist dispenser assembly is configured to deliver a heated misted liquid to a skin surface area of a user.

11 Claims, 10 Drawing Sheets

(51) Int. Cl.
*A61H 33/00* (2006.01)
*A61H 33/06* (2006.01)

(56) References Cited

U.S. PATENT DOCUMENTS

| | | | | |
|---|---|---|---|---|
| 6,755,398 | B1 * | 6/2004 | Wong | A61H 33/063 261/127 |
| 8,157,753 | B2 * | 4/2012 | Nichols | A61H 7/004 601/17 |
| 8,343,116 | B2 * | 1/2013 | Ignon | A61B 17/54 604/289 |
| 2008/0189951 | A1 * | 8/2008 | Molema | B26B 19/40 30/41 |
| 2010/0217357 | A1 | 8/2010 | Da Silva et al. | |
| 2012/0209151 | A1 * | 8/2012 | Zhou | A61H 23/0245 601/2 |
| 2016/0058156 | A1 * | 3/2016 | Chiasson | A45D 40/24 132/200 |

* cited by examiner

DEEP PORE CLEANSING DEVICE CONFIGURED TO DELIVER A CYCLICAL MECHANICAL STRAIN AND MIST TO SKIN

BACKGROUND

Field

The disclosure herein generally relates to an apparatus and method for skin treatment which includes using the cyclical movement of a brushhead assembly, in combination with a heated mist to the skin area, all in a portable battery operated appliance.

SUMMARY

According to an embodiment, there is provided a portable skin cleaning apparatus including a cleanser assembly configured to apply a cyclical mechanical force to a skin surface area of a user with a cleaning object, and a mist dispenser assembly configured to deliver a heated misted liquid to a skin surface area of a user.

According to an embodiment, the mist dispenser assembly includes circuitry configured to activate delivery of the heated misted liquid to a skin surface area of a user.

According to an embodiment, the portable skin cleaning apparatus includes a memory configured to store a predetermined profile that includes at least one of a predetermined temperature and time setting, wherein the mist dispenser assembly is configured to deliver the heated misted liquid to a skin surface area of a user based on the predetermined profile.

According to an embodiment, the predetermined profile further includes a time setting for applying the cyclical mechanical force of the cleanser assembly to the skin surface of the user, and the predetermined profile specifies a sequence for operating the mist dispenser assembly and the cleanser assembly relative to each other.

According to an embodiment, the portable skin cleaning apparatus includes a storage container configured to store a liquid;

According to an embodiment, the storage container is detachable from the portable skin cleaning apparatus.

According to an embodiment, the detachable storage container is a single-use storage container.

According to an embodiment, the storage container is configured to hold multiple reservoirs which each separately store a liquid.

According to an embodiment, the portable skin cleaning apparatus includes a first storage container and a second storage container each configured to store a liquid as a source for the heated misted liquid, wherein the second storage container is provided closer to the mist dispenser assembly than the first storage container and has a smaller volume than the first storage container.

According to an embodiment, the portable skin cleaning apparatus includes a heating element configured to receive the liquid from the storage unit and heat the liquid.

According to an embodiment, the heating element is a thin resistive heater provided within or adjacent to the mist dispenser assembly.

According to an embodiment, the portable skin cleaning apparatus includes a delivery mechanism configured to receive the heated liquid and emit particles of the heated liquid to the skin surface area of the user.

According to an embodiment, the delivery mechanism is a nebulizer.

According to an embodiment, the delivery mechanism is integrated with the cleanser assembly.

According to an embodiment, the cleanser assembly includes a plurality of brush bristles configured to apply the cyclical mechanical force to the skin surface of the user.

According to an embodiment, the portable skin cleaning apparatus includes a battery power supply configured to provide power to at least the cleanser assembly and the mist dispenser.

According to an embodiment, there is provided a method of skin cleansing including delivering, with a mist dispenser assembly of a portable skin cleaning apparatus, configured, a heated misted liquid to a skin surface area of a user, and applying, with a cleanser assembly of the portable skin cleaning apparatus, a cyclical mechanical force to the skin surface area of the user with a cleaning object According to an embodiment, the method of skin cleansing includes applying a cleansing solution to the skin of the user.

According to an embodiment, the cleansing solution includes a water activated exothermic compound.

According to an embodiment, the delivering and applying steps are performed automatically according to a predetermined profile stored at the portable skin cleaning apparatus, the predetermined profile including a predetermined temperature and time setting for delivering the heated misted liquid and a time setting for applying the cyclical mechanical force.

According to an embodiment, there is provided a portable skin cleaning apparatus including a cleanser assembly configured to apply a cyclical mechanical force to a skin surface area of a user with a cleaning object, and a mist dispenser assembly configured to deliver a misted liquid to a skin surface area of a user.

According to an embodiment, there is provided a storage container configured to store a liquid, a heating element configured to receive the liquid from the storage unit and heat the liquid, and a mist dispenser assembly configured to deliver a heated misted liquid to a skin surface area of a user.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Dermal infusion devices and methods are provided that improve dermal delivery of a topical formulation. In the description herein, the terms "infusion" and "absorption" are used interchangeably. In an embodiment, the devices are configured to direct two different frequencies of cyclical motion (e.g., sonic and ultrasonic) towards the skin of a subject. The combination of the two different frequencies results in improved dermal infusion capabilities and can be used, for example, to effect dermal delivery of a topical formulation. By improving dermal delivery, the disclosed embodiments can reduce the treatment time required to deliver an effective amount of formula. Another significant advantage is that it is can be agent agnostic, meaning that because it mechanically increases the permeability of the stratum corneum, it does not rely on charge, hydrophilicity, or diamagnetic properties of the cosmetic or therapeutic agent to increase flux.

Figure 1:
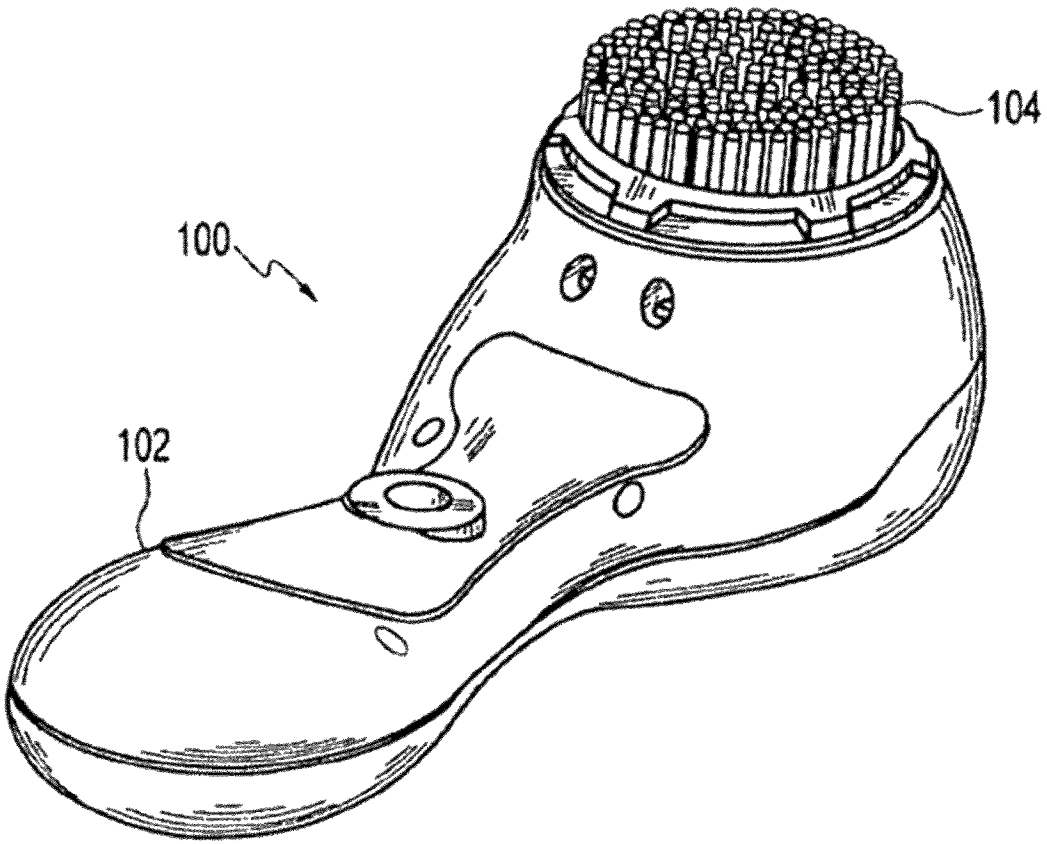
FIG. 1 illustrates a portable skin cleaning appliance according to an embodiment.
Figure 2C:
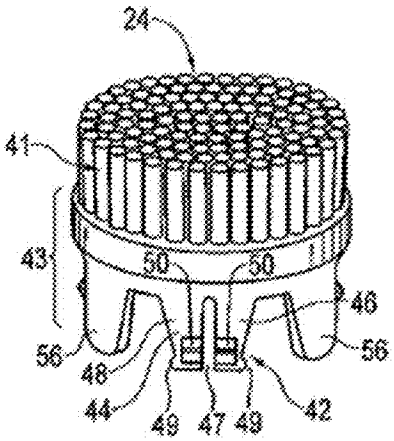
FIGS. 2A, 2B, and 2C illustrate different views of a brushhead assembly according an embodiment.

A representative skin brush appliance is shown generally at 100 in FIG. 1. The appliance includes a handle portion 102 and a removable brushhead portion 104. In the embodiments shown in FIGS. 2A-2C, the brushheads of the appliance 100 may have a particular configuration. However, it should be understood that other brushhead configurations and arrangements can be used. See e.g., U.S. Pat. Nos. 7,789,092; 8,484,788; and 8,641,702, each of which is incorporated herein by reference. The brushhead arrangement (FIG. 2A is exemplary) may include two concentric outer rings of bristle tufts 106 and 108 in an outer portion 110 and 6 concentric inner rings 112-117 of bristle tufts in an inner portion 118. The rings 106 and 108 in outer portion 110 remain stationary in operation, while rings 112-117 in inner portion 118 may rotate through a selected angle. Generally, this angle is in the range of 2-30°, with a preferred range of approximately 5-20°. The oscillation occurs within a some frequency range of 60-200 Hz. In an embodiment, the oscillation occurs within a some frequency range of 160-180 Hz. In an embodiment, the oscillation frequency is approximately 176 Hz. In an embodiment, the oscillation frequency is approximately 168 Hz. The outer portion 110 comprising outer rings 106 and 108 provides a splash barrier for the oscillating rings of the inner portion 118, as well as a stationary contact ring by which the oscillating action of the bristle tufts of the inner portion creates localized shear skin stresses for effective cleansing of the skin without damage or harm to the skin. This action is described in more detail in U.S. patent application Ser. No. 10/345,909, which is owned by the assignee of the present application, the contents of which are hereby incorporated by reference.

In the embodiment shown, there are 50 tufts in each outer ring 106 and 108, while inner rings 112 and 113 have 24 tufts, rings 114 and 115 have 15 tufts, and rings 116 and 117 have 10 tufts each. It should be understood, however, that this specific arrangement can be varied. Alternatively, the brushhead could comprise a basic plurality of bristle tufts, with the brushhead moving back and forth about a rest or neutral position. The movement could be longitudinal, lateral, or other more complex motions, as long as the movement creates localized shear stress for cleansing of the skin. Optionally, there may also be a plurality of individual light sources 124-124 are positioned within the inner (oscillating) portion of the brushhead.

Figure 2B:
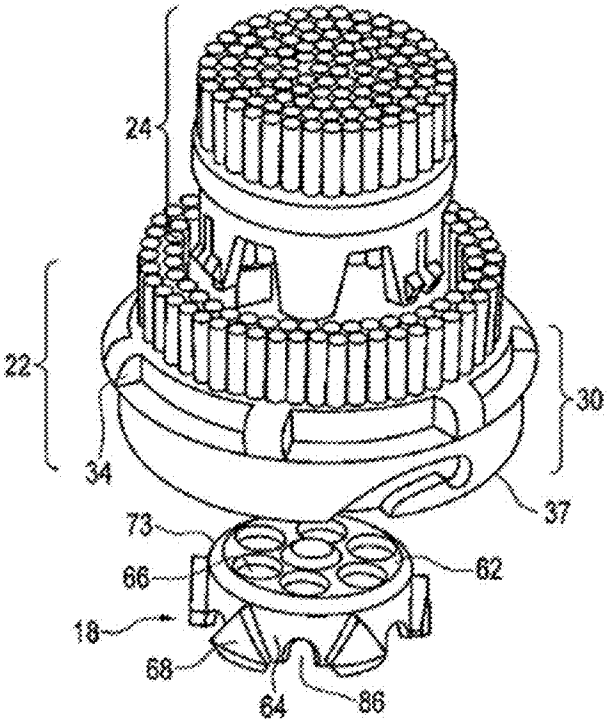
Figure 2A:
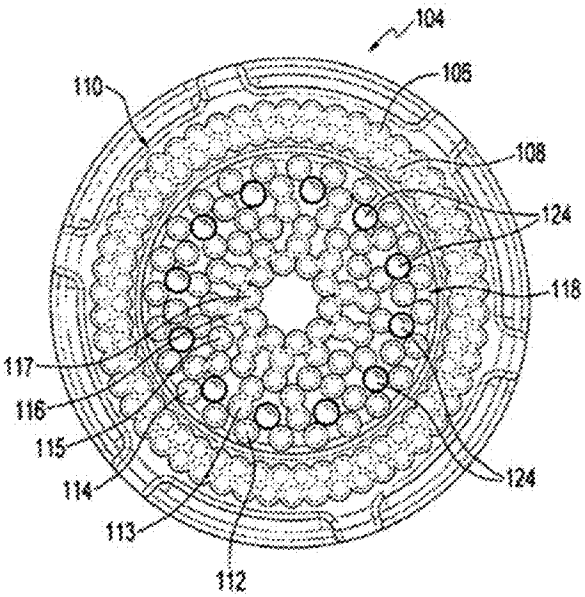

Referring now to FIG. 2B, the brushhead attachment mechanism includes three portions, drive hub 18, an outer brushhead portion 22, which remains stationary during operation of the appliance, and an inner brushhead portion 24 which oscillates through a selected angle during operation of the appliance. The inner brushhead portion 24 has an operative relationship with drive hub 18 such that as drive hub 18 oscillates through a selected angle, so does inner brushhead portion 24.

In the embodiment shown, outer brushhead portion 22 is annular, with an outside diameter of approximately 1.975 inches, with a central opening. Outer brushhead portion 22 includes a base portion 30 with a rim around the top periphery thereof which includes a plurality of spaced finger grips 34, which helps the user in the installation and removal of the brushhead assembly. Furthermore, as shown in FIG. 2B, there is a lower edge 37 of base 30 of the outer brushhead portion 22. Drive hub 18 is generally circular in configuration, with an upper surface 62, a depending circular wall 64 and a series of diamond-shaped projections 66 on the wall at spaced intervals, separated by clearance space into which the snap legs 42 and drive legs 56 can fit. In the embodiment shown, drive hub 18 includes a number of openings 68 in the upper surface 62 thereof, to facilitate cleaning and draining of the bristles in the outer and inner brushhead portions. Circular wall 64 is tapered slightly outwardly from top to bottom to produce a splaying effect on all the legs of the inner brushhead portion 24, to assure a snug fit between the inner brushhead portion 24 and the drive hub 18. The diamond-shaped projections 68 on the wall 64 come to a point at the top edge 73 of wall 64.

Inner brushhead portion 24 is shown in more detail in FIG. 2C. It has a generally circular configuration and is arranged to fit into the central opening of outer brushhead portion 22. There could be a gap (space) between the bristles and the inner and outer brushhead portions, in the range of 0.050-0.125 inches, preferably 0.084 inches. Inner brushhead portion 24 includes a plurality of inner brushhead bristles 41 which extend upwardly from a base portion 43, with the bristles 41 arranged in a circular pattern covering the entire upper surface of base portion 43. The inner brushhead portion 24 in the embodiment shown includes two sets of depending legs on the outer periphery thereof. The first set of three legs 42-42, spaced at 120° intervals, each leg comprising a pair of snap portions 44 and 46, defined by a slot 47 which extends down the middle of each snap leg 42.

The two snap portions of each snap leg are configured and arranged to slightly flex toward each other during installation of the inner brushhead portion 24 on the driving hub 18, with the outside edges of the free tips of the snap portions 44, 46 having outward bulges 49-49 which snap back (with the snap portions) after they pass over a pointed portion of the drive hub, helping to tightly engage the drive hub 18 and retain the inner brushhead portion 24 on drive hub 18. The inner brushhead portion 24 further includes a second trio of spaced drive legs 56-56. Drive legs 56 alternate with snap legs 42 around the periphery of inner brushhead portion 24 and are also separated by 120° intervals. Drive legs 56 taper slightly from their base to their free ends, which are rounded, designed to provide a close tolerance fit between them and the drive hub. Extending outwardly from outer surface 48 of each snap portion is locking snap elements 50. The brushhead structure and assembly is described in more detail in U.S. Pat. No. 7,386,906, which is owned by the assignee of the present application and is incorporated herein by reference.

The brushhead bristle arrangement shown and described herein, used in the appliance/brushhead disclosed in the above applications is effective for skin cleaning applications, particularly facial skin. The present brushhead bristle arrangement can also be used in other skin care applications, however, as discussed in the above applications, including acne and black head treatment, athlete's foot treatment, callused skin and psoriasis, razor bumps and related skin applications, wound cleansing and treatment of slow or non-healing wounds, scalp cleaning, chemical peel procedures and shaving cream applications. Preferred bristle configurations and arrangements will differ somewhat depending upon the particular application.

There is currently no device which effectively combines the benefits of sonic cleansing with the benefits of steam, mist, or heated mist into a single compact personal appliance that is convenient, inexpensive, and simple to use. Steam, mist, or heated mist therapy can be used in skin treatment for help with deep cleansing, to open pores for increased infusion, to stimulate circulation and general relaxation, and to generally moisturize the skin of treatment of skin conditions using narrowband light.

Figure 3:
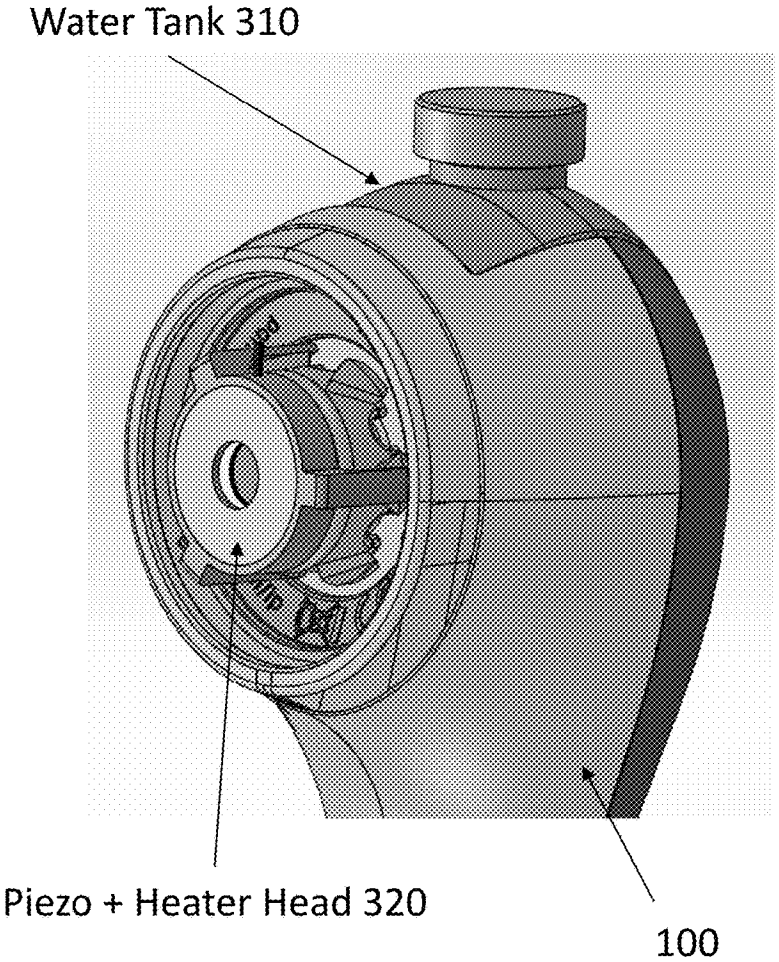
FIG. 3 illustrates a portable skin cleaning appliance including an assembly having a water tank and a heating element according to an embodiment.

FIG. 3 shows a modification to the appliance 100 according to an embodiment. In FIG. 3, the housing of the appliance 100 is modified to incorporate an assembly 400 (shown in FIG. 4), which includes a water tank 310 coupled to a heating element 320. In an embodiment, the heating element 320 is made from a thin resistive heater coupled to a nebulizer. In an embodiment, during operation, the appliance 100 includes one or more assemblies for generating a mist and heating the mist without substantially generating steam. In an embodiment, during operation, the appliance 100 includes one or more assemblies for generating a mist and heating the mist to a temperature that is below a steam state. In an embodiment, during operation, the appliance 100 includes one or more assemblies for generating a mist and heating the mist to a temperature of less than 100° C.

In an embodiment, during operation, the appliance 100 includes one or more assemblies for generating a mist and heating the mist to a temperature ranging from about 25° C. to about 100° C. In an embodiment, during operation, the appliance 100 includes one or more assemblies for generating a mist and heating the mist to a temperature ranging from about 37° C. to about 100° C. In an embodiment, during operation, the appliance 100 includes one or more assemblies for generating a mist and heating the mist to a temperature ranging from about 45° C. to about 75° C.

The brushhead shown in FIGS. 1 and 2 above is modified from a standard configuration to have both longer attachment legs as well as clearances to cradle the heater/nebulizer unit. For instance, the legs 42 and 56 shown in FIG. 2C are designed to have a distance of at least, for example, 7 mm. This modification is required to disengage the brushhead from the additional mass of heater/nebulizer which otherwise could dampen or stop the device motion.

Figure 4:
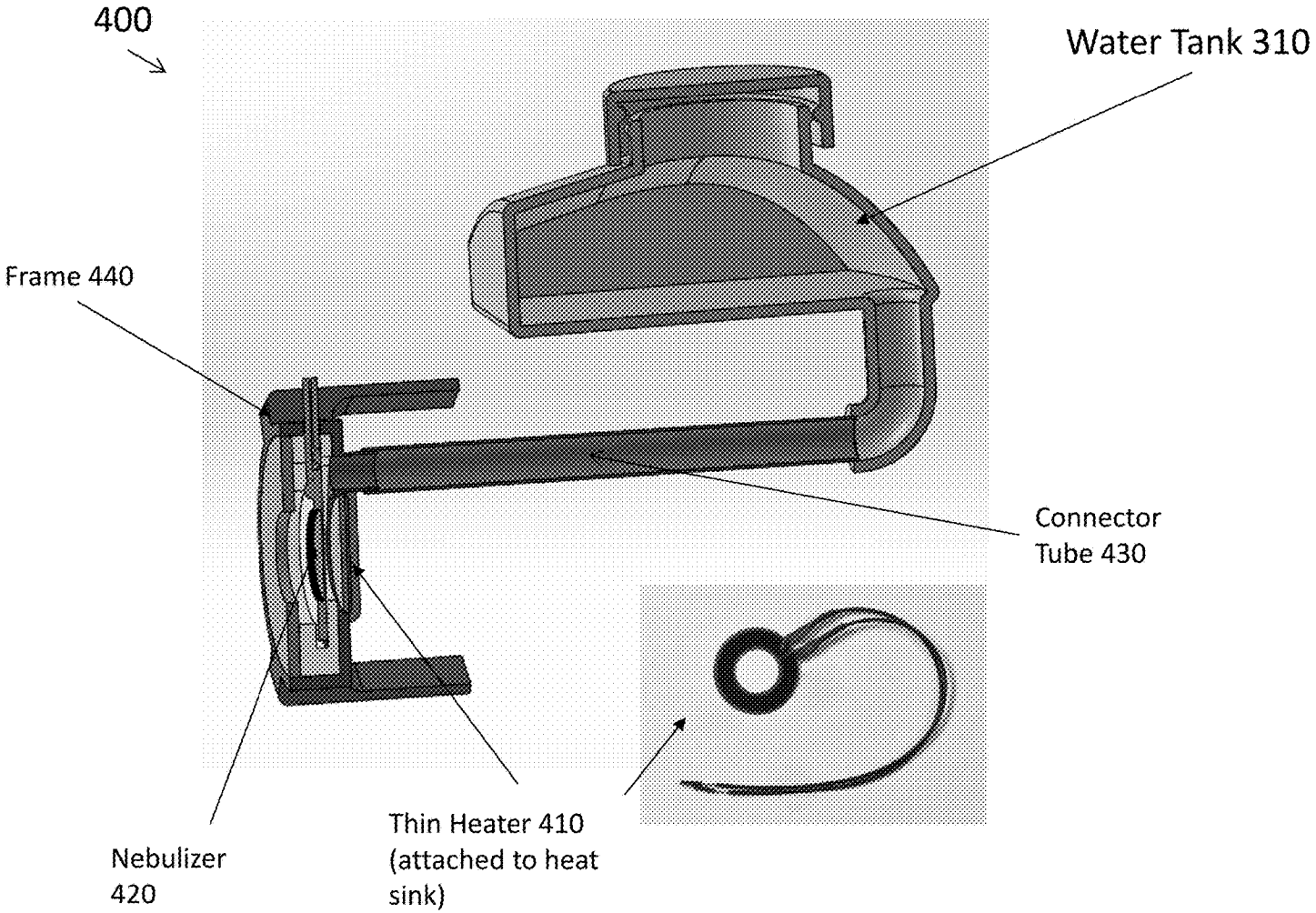
FIG. 4 illustrates a view of the assembly which includes the water tank and the heating element according to an embodiment.

FIG. 4 shows a profile view of the assembly 400 removed from the appliance housing 100. It can be seen that the thin heater 410 is attached to a heat sink. This heat sink warms the water in the chamber which feeds the nebulizer 420. The drive circuitry of nebulizer is separate from the heater to allow for the water to warm to the desired temperature before being sprayed out. The nubulizer may be an ultrasonic wave nebulizer, in which an electronic oscillator generates a high frequency ultrasonic wave, which causes the mechanical vibration of a piezoelectric element. This vibrating element is in contact with the liquid and its high frequency vibration is sufficient to produce a vapor mist.

A connection tube 430 connects the heater/nebulizer unit to the water tank 310. A frame 440 attaches the heater/nebulizer unit to the appliance 100.

Figure 5:
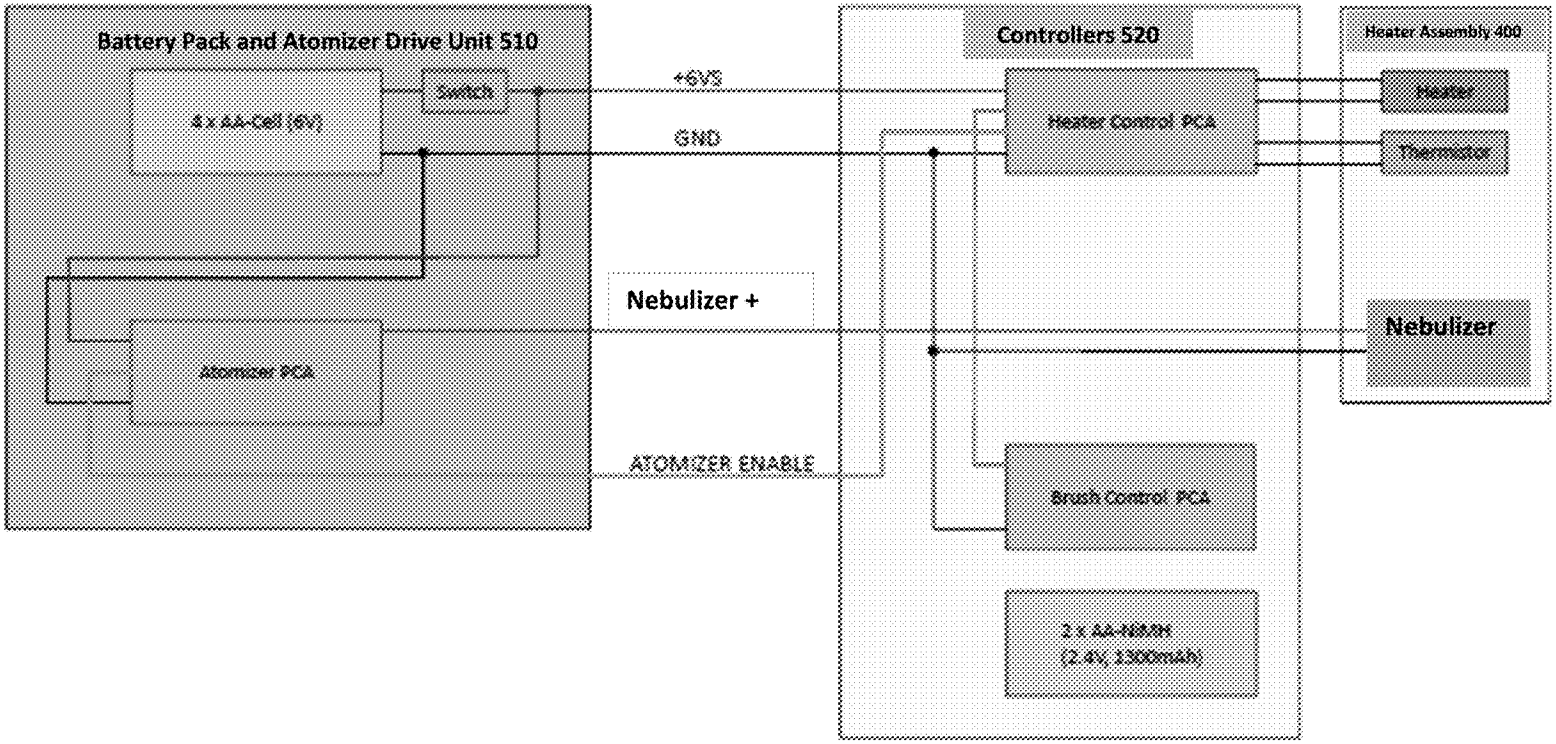
FIG. 5 illustrates a wiring diagram for the personal skin cleaning appliance according to an embodiment.

FIG. 5 shows a wiring diagram for providing power and control signals to the brush head and the heater assembly 400. FIG. 5 shows that the appliance 100 includes an external battery pack and atomizer drive unit 510, a controller unit 520, and the heater assembly 400. The external battery pack may include 4×AA-Cell (6V) batteries which provides power to at least the heater control PCA (printed circuit assembly) card and possibly the brush control PCA card. There may also be a separate power source such as a 2×AA-NiMH (2.4 V, 1300 mAh) power supply for the brush control PCA card. The atomizer PCA provides the drive circuitry for the nebulizer. A thermistor may be used to measure the temperature of the heater, and to provide feedback to the heater control PCA to increase or decrease current to the heater to allow a desired temperature to be reached. The heater control PCA also provides a control signal (atomizer enable) to the atomizer PCA to enable or disable operation of the nebulizer.

Figure 6:
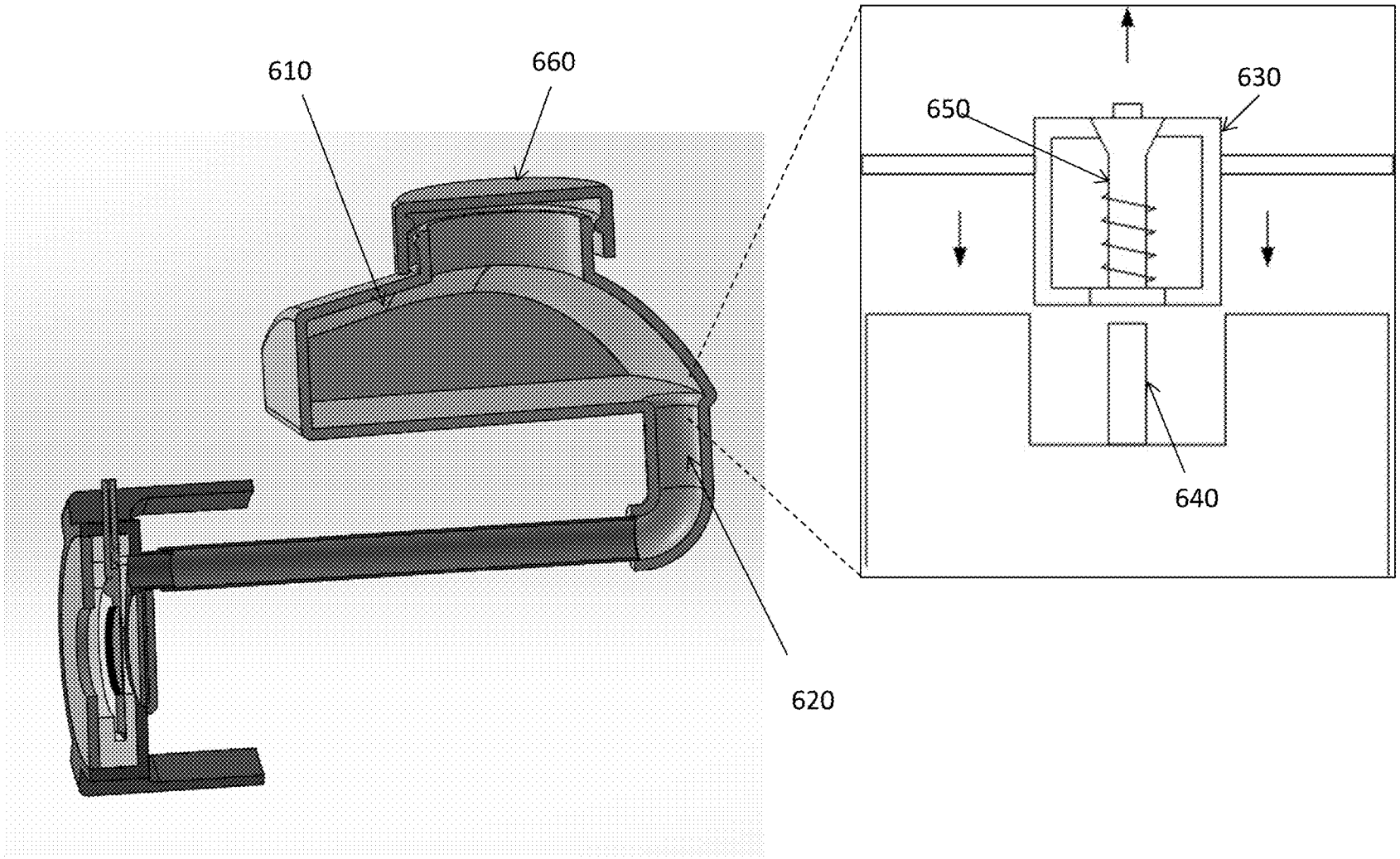
FIG. 6 illustrates an embodiment where the water tank is detachable.

In another embodiment, the water tank 310 show in FIGS. 3 and 4 is removable as shown in FIG. 6. For instance, such a removable water tank may be in the form of a cartridge or capsule 610. Such cartridges are stand alone and can be added or exchanged from the devices as the user desires. Such a cartridge can be attached to the connector tube 620 using a push plunger valve 630 as known in the art. A protruding part 640 on the connector tube pushes up on the plunger valve 650 (which may be biased by a spring) when the cartridge is mounted to the appliance 100 to release the water or liquid from the cartridge to flow into the connector tube. The cap 660 is optional in FIG. 6 and it may be absent. The plunger valve 630 may also act as a removable cap using techniques readily understood to a person of ordinary skill in the art. Furthermore the cartridge or capsule may be a single-use cartridge and it may be sealed or contained in a manner known the art without providing cap access to refill the cartridge. The water tank may also contain a removable reservoir or it may be modular such that it is configured to hold multiple modular reservoirs which each separately store a liquid to be released into the connector tube and which themselves may also be removable.

Figure 7:
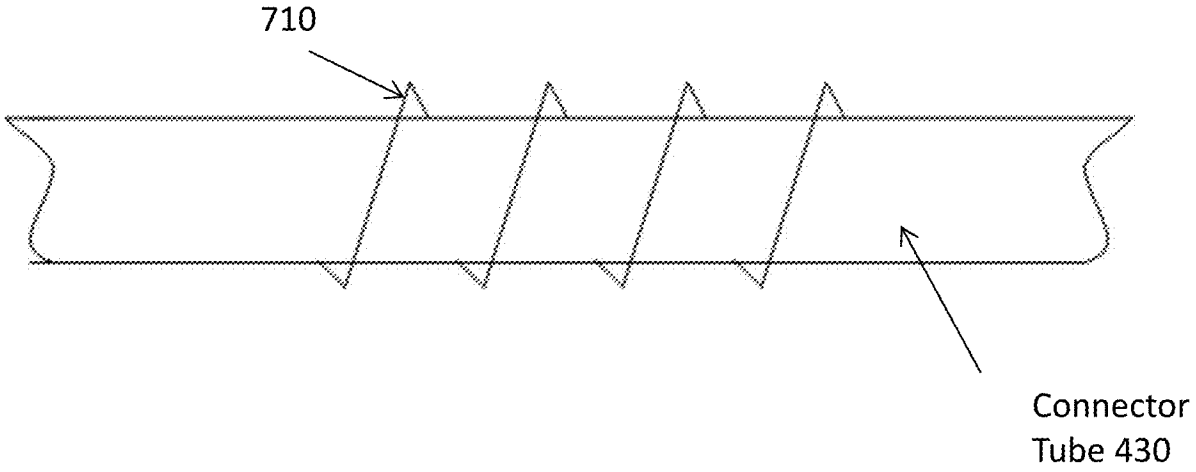
FIG. 7 illustrates an embodiment where a heating element is applied to a connector tube.

In another embodiment, a resistive heater in the form of a coil 710 is applied to the connector tube 430. In this embodiment, the water is heated as it flows through the connector tube to the nebulizer. Similar to the thin resistive heater discussed above, the resistive heater shown in FIG. 7 is controlled based on increasing or decreasing the current applied to the coil.

Figure 8:
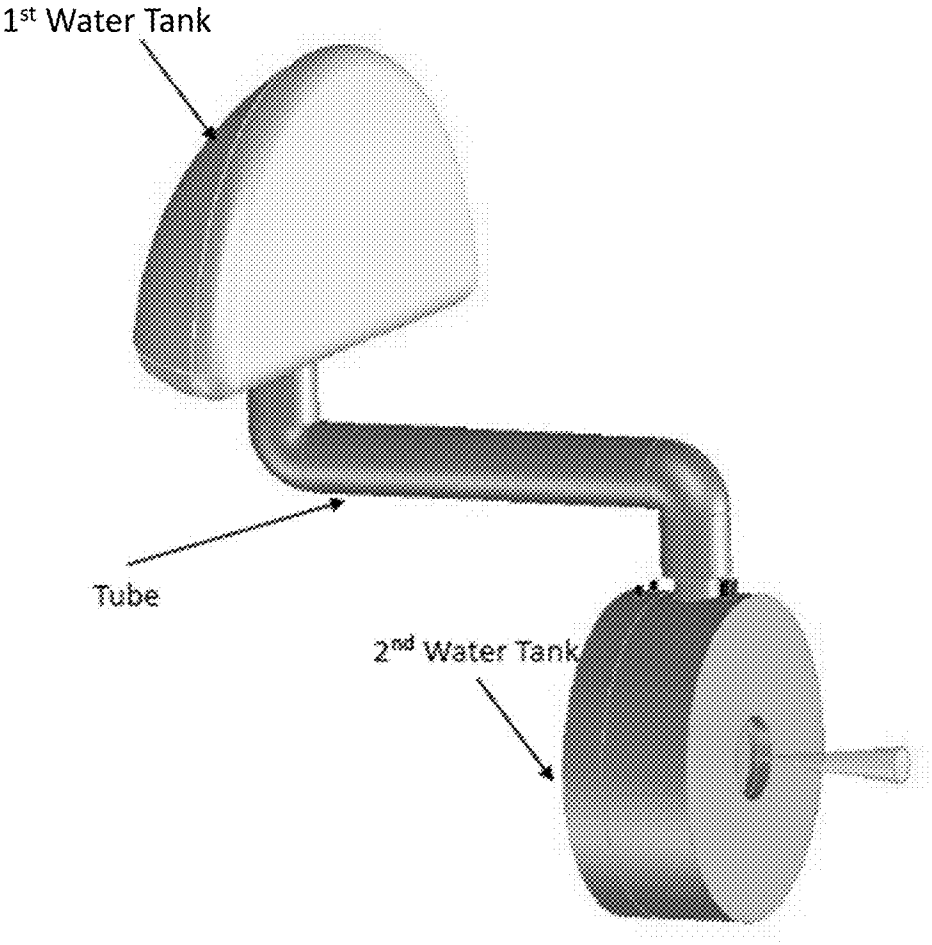
FIG. 8 illustrates an embodiment of an assembly that includes two different water tanks.

In another embodiment shown in FIG. 8, the heater assembly is shown similar to the heater assembly shown above, but a second water tank is provided at the location of the heater/nebulizer. The first water tank provides a larger fluid reservoir for easier and fewer filling by the user. It's then connected to the second tank by a tube. The smaller volume of second water tank allows for closer proximity to the application point as well as a faster heating with lower energy than otherwise. The heater and nebulizer function is integrated into this second tank and stands behind the brushhead.

In an embodiment, resistive heater 410 shown in FIG. 4 has a 4Ω resistance and heats up the water or liquid for about 10 seconds at 16.5 W (8.2V, 2 A) to a temperature between 70-80 degrees (C.). The mist created is delivered at a rate of 2 mL/M at 6.25 W to maintain the chamber water temperature. With the typical cooling of mist in room temperature air, the water temperature as hits the skin in distance of about 15 mm is 40-45 degrees (C.)

Figure 9:
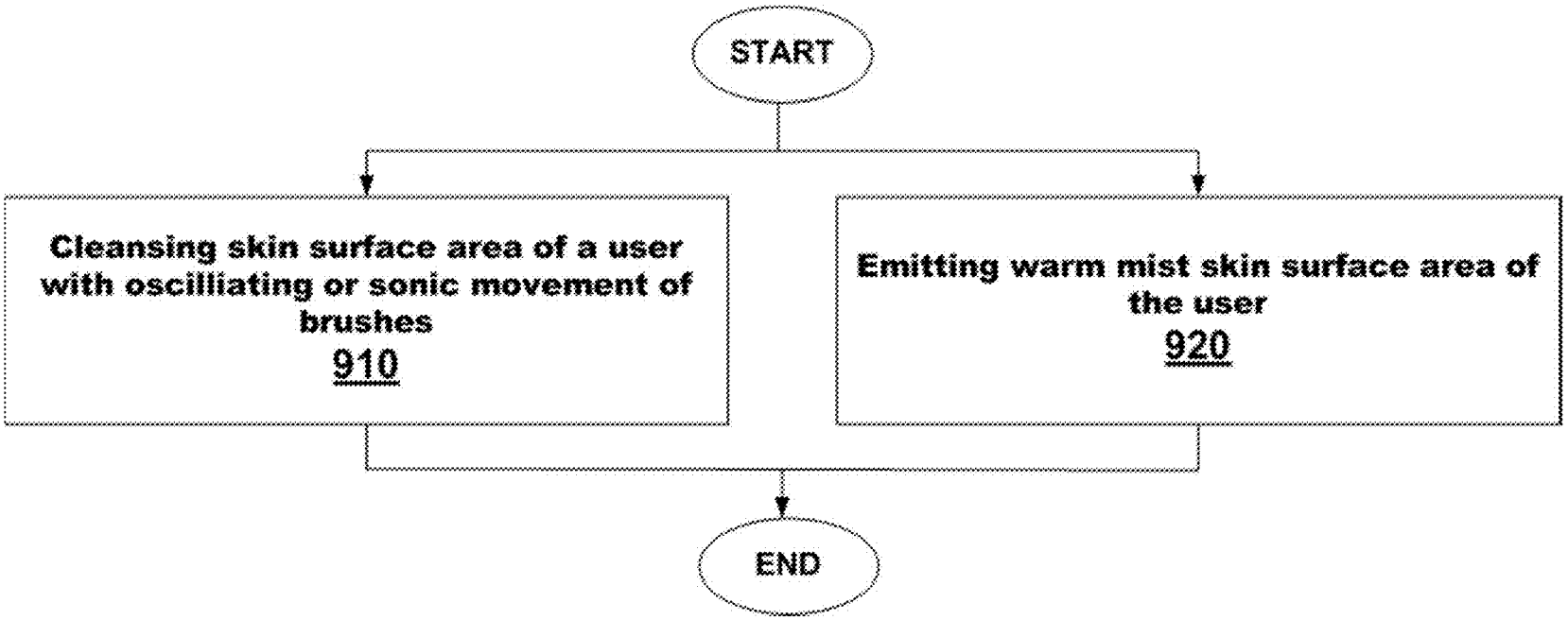
FIG. 9 illustrates a method performed using a person skin cleaning appliance according to an embodiment.

FIG. 9 shows a method implemented by the appliance 100 described above. In step 910, the brushhead performs a process of contacting and cleansing a skin surface of a user according to the oscillating or sonic movement of the brush bristles described above. Simultaneously, in step 920, the assembly 400 performs a process of emitting warm mist to the skin surface of the user. These two processes can be started and ended at separate times according to separate on/off switches, or they can be started and ended simultaneously according to the same on/off switch.

Figure 10:
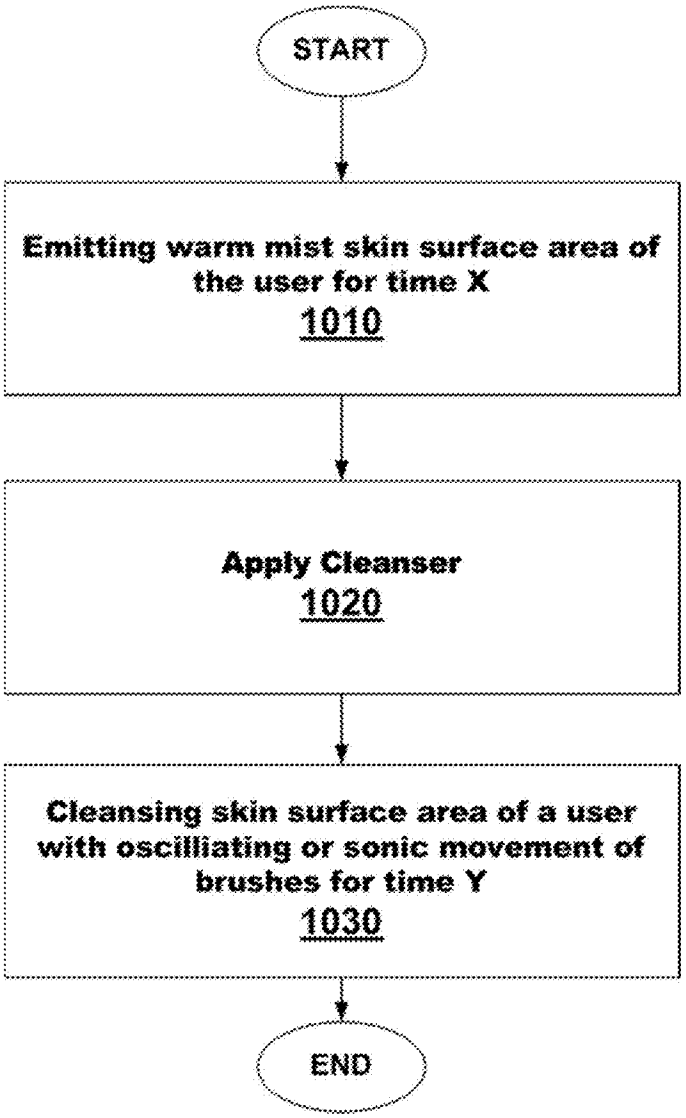
FIG. 10 illustrates an alternative method performed using a skin cleaning appliance according to an embodiment.

FIG. 10 shows a different method implemented by the appliance 100 described above. In step 1010, the assembly 400 performs a process of emitting warm mist to the skin surface of the user for a certain amount of time. In one example, this amount of time is one minute. In step 1020, a cleansing product is applied to the skin or to the surface of the brush bristles by the user. In step 1030, the brushhead performs a process of contacting and cleansing a skin surface of a user according to the oscillating or sonic movement of the brush bristles described above for a certain amount of time. In one example, this amount of time is five seconds.

The times for any of the steps shown in FIGS. 9 and 10 may vary according to the desired results of the user. In an embodiment, the appliance 100 includes a memory that stores temperature and/or time profiles for completing the steps shown in FIGS. 9 and 10, and a sequence and time of performing the steps shown in FIGS. 9 and 10 can be automatically performed after receiving an input from the user to select and start a process according to the stored profile.

In this disclosure, steamer functionality is integrated into a battery-operated cleansing device. The key characteristic of this innovation is to spray fine particles (~100 um) of heated water to mimic the effects of steam without the need for extremely high energies required for generating steam directly (saving 2.2 kJ/cc of water). The innovation combines existing technologies for creating fine mist (through techniques like ultrasound and use of fine mesh) along with heating limited water from a reservoir before spray is done.

The advantage of this mechanism is to use all the steamer benefits in addition to the sonic cleansing. Furthermore, since this integrated device, delivers steam only to a small area, a significantly lower amount of steam would be required; this in turn reduces the power requirements and possibility for excessive variation.

The hot water would give the sensation of steam even though the effect would be muted due to the lower energy content. The close timing combination of steam and sonic cleansing would allow maximizing the two benefits. Steam softens the skin, opens up pores, and breaks down oil and make ups on the skin, which naturally would enhance cleansing effects of Sonic device Furthermore, since this integrated device delivers steam only to a small area, a significantly lower amount of steam would be required; this in turn reduces the power requirements and limits the possibility for excessive temperature variations.

In another embodiment, a water activated exothermic compound is incorporated into the cleansing solution. Such compounds typically require direct water and agitation for the full heat release. Combining such characteristic with a steam device, mist device, or heated mist device would augment the expected sensation of heat at target location without additional power or risk requirement at the device level.

In another embodiment, the brush head attachment is not attached to the appliance 100, such that the appliance 100 primarily provides heated mist.

In another embodiment, the appliance 100 does not include a heating element, such that room temperature or cool mist is injected through the nebulizer.

Numerous modifications and variations of the present disclosure are possible in light of the above teachings. It is therefore to be understood that within the scope of the appended claims, the claimed invention may be practiced otherwise than as specifically described herein.

What is claimed is:

1. A portable skin cleaning apparatus comprising:

a handle portion;

at least one storage container configured to store a liquid;

a cleanser assembly configured to apply a cyclical mechanical force to a skin surface area of a user with a cleaning object;

a heating element configured to receive the liquid from the at least one storage container and heat the liquid; and a delivery mechanism configured to receive the heated liquid and emit particles of the heated liquid as a heated misted liquid to the skin surface area of a user, wherein the at least one storage container includes a first storage container and a second storage container each configured to store the liquid as the source for the heated misted liquid, wherein the second storage container is provided closer to the delivery mechanism than the first storage container and has a smaller volume than the first storage container.

2. The portable skin cleaning apparatus according to claim 1, wherein the delivery mechanism includes circuitry configured to activate delivery of the heated misted liquid to the skin surface area of a user.

3. The portable skin cleaning apparatus according to claim 1, further comprising a memory configured to store a predetermined profile that includes at least one of a predetermined temperature and time setting, wherein the portable skin cleaning apparatus is configured to deliver the heated misted liquid to the skin surface area of a user based on the predetermined profile.

4. The portable skin cleaning apparatus according to claim 3, wherein the predetermined profile further includes a time setting for applying the cyclical mechanical force of the cleanser assembly to the skin surface of the user, and the predetermined profile specifies a sequence for operating the delivery mechanism and the cleanser assembly relative to each other.

5. The portable skin cleaning apparatus according to claim 1, wherein the second storage container is detachable from the handle portion of the portable skin cleaning apparatus.

6. The portable skin cleaning apparatus according to claim 5, wherein the detachable second storage container is a single-use storage container.

7. The portable skin cleaning apparatus according to claim 1, wherein the heating element is a thin resistive heater provided within or adjacent to the delivery mechanism.

8. The portable skin cleaning apparatus according to claim 1, wherein the delivery mechanism is a nebulizer.

9. The portable skin cleaning apparatus according to claim 1 wherein the delivery mechanism is integrated with the cleanser assembly.

10. The portable skin cleaning apparatus according to claim 1, wherein the cleanser assembly includes a plurality of brush bristles configured to apply the cyclical mechanical force to the skin surface of the user.

11. The apparatus according to claim 1, further comprising a battery power supply configured to provide power to at least the cleanser assembly and the delivery mechanism.

* * * * *